US005259286A

United States Patent [19]

Chen

[11] Patent Number: 5,259,286

[45] Date of Patent: Nov. 9, 1993

[54] CARPENTER'S WORKBENCH

[76] Inventor: Chuan-Wu Chen, No 64-2, Chiu Sheh Lane, Chiu Sheh, Pei Tun Area, Taichung, Taiwan

[21] Appl. No.: 970,383

[22] Filed: Nov. 2, 1992

[51] Int. Cl.[5] ..... B27G 5/02

[52] U.S. Cl. ..... 83/766; 83/767; 83/468.3; 83/581

[58] Field of Search ..... 83/761, 762, 764, 767, 83/468, 468.3, 581, 471.3, 766

[56] References Cited

U.S. PATENT DOCUMENTS

| | | | |
|---|---|---|---|
| 1,002,980 | 9/1911 | Fish | 83/767 |
| 1,208,150 | 12/1916 | Hall | 83/767 |
| 1,332,714 | 3/1920 | D'arcy | 83/767 |
| 1,458,951 | 6/1923 | Poole et al. | 83/766 |
| 2,708,466 | 5/1955 | Stoll | 83/766 |
| 3,948,136 | 4/1976 | Gutowski et al. | 83/767 |

*Primary Examiner*—Eugenia Jones

*Attorney, Agent, or Firm*—Browdy and Neimark

[57] ABSTRACT

A carpenter's workbench comprises a bench top having thereon a baffle, a suspension arm disposed pivotally under the bench top, and a pair of sawing supports fastened respectively to the two ends of the suspension arm. The axial center of the pivoting moment of the suspension arm is coplanar with the inner surface of the baffle. Each of the two ends of the suspension arm is provided with a receiving mount having a recess provided at the inner edge thereof with a plurality of receiving surfaces adjacent to one another. Each of the sawing supports has a retaining mount which is provided thereon with a plurality of support rods and with a plurality of restraining surfaces adjacent to one another and which is located at the outer edge thereof. The receiving surfaces and the restraining surfaces are similar in length and angles formed so as to permit each restraining mount to be received securely in the corresponding recess.

8 Claims, 4 Drawing Sheets

CARPENTER'S WORKBENCH

BACKGROUND OF THE INVENTION

The present invention relates to a carpenter's workbench, and more particularly to a carpenter's workbench provided with a means facilitating a hacksaw disposed on the workbench to be adjusted for its sawing angle with precision.

According to the prior art of carpentry, a carpenter's workbench comprises a bench top for placing thereon a wooden material intended to be sawed, a suspension arm pivoted to the bench, a pair of sawing supports pivoted to both ends of the suspension arm in a manner that both sawing supports extend upwards, and a hacksaw mounted on the sawing supports in a manner that the hacksaw traverses the workbench. Before sawing the wooden material placed on the bench top, a carpenter can locate both suspension arm and sawing supports by turning them respectively along the directions of X axis and Y axis, so as to preset the angle between the cut at the end of the wooden material and the axis of the saw.

Both ends of the suspension arm are provided respectively with an arcuate recess while the sawing supports are provided respectively with an arcuate sliding block corresponding in location to the arcuate recess. Each arcuate sliding block can be therefore inserted into the arcuate recess so as to permit the sawing supports to be turned at will on the axial center of the arcuate recess to form a desired angle. Such turning mechanism is defective in design and has the shortcomings, which are expounded hereinafter.

It is well known among the carpenters that the sawing angles that are needed in sawing a wooden material are plus and minus 45 degrees. and 90 degrees. Therefore, it is impractical and needless to have the sawing supports that can be adjusted for any angle. In order for the sawing supports to be adjusted for any sawing angle, the sawing supports must be provided with many additional component parts.

When the downward sawing of the hacksaw takes place, the hacksaw and the sawing supports form a moment, in view of the fact that the contact portion between the sawing supports and the suspension arm is arcuate. As a result, a displacement of the relative position between the sawing supports and the suspension arm takes place, thereby resulting in distorting the preset angle.

SUMMARY OF THE INVENTION

It is, therefore, the primary objective of the present invention to provide a carpenter's workbench, which is simple in structure and is therefore cheaper to make.

It is another objective of the present invention to provide a carpenter's workbench with suspension arm and sawing supports, which can be located securely.

In keeping with the principles of the present invention, the foregoing objectives of the present invention are accomplished by a carpenter's workbench, which comprises mainly a bench top, a suspension arm disposed pivotally under the bench top, and a pair of sawing supports pivoted respectively to both ends of the suspension arm. The workbench is characterized in that both ends of the suspension arm are provided respectively with receiving mounts, each of which has several receiving surfaces adjacent to one another. There is a predetermined angle between the two receiving surfaces. The workbench is further characterized in that the underside of the sawing support is provided with a retaining mount having several retaining surfaces adjacent to one another. Each of the retaining surfaces has an angle with a depth similar in length to the receiving surface, so as to retain securely the sawing supports and the suspension arm.

DETAILED DESCRIPTION OF THE PREFERRED EMBODIMENT

Figure 1:
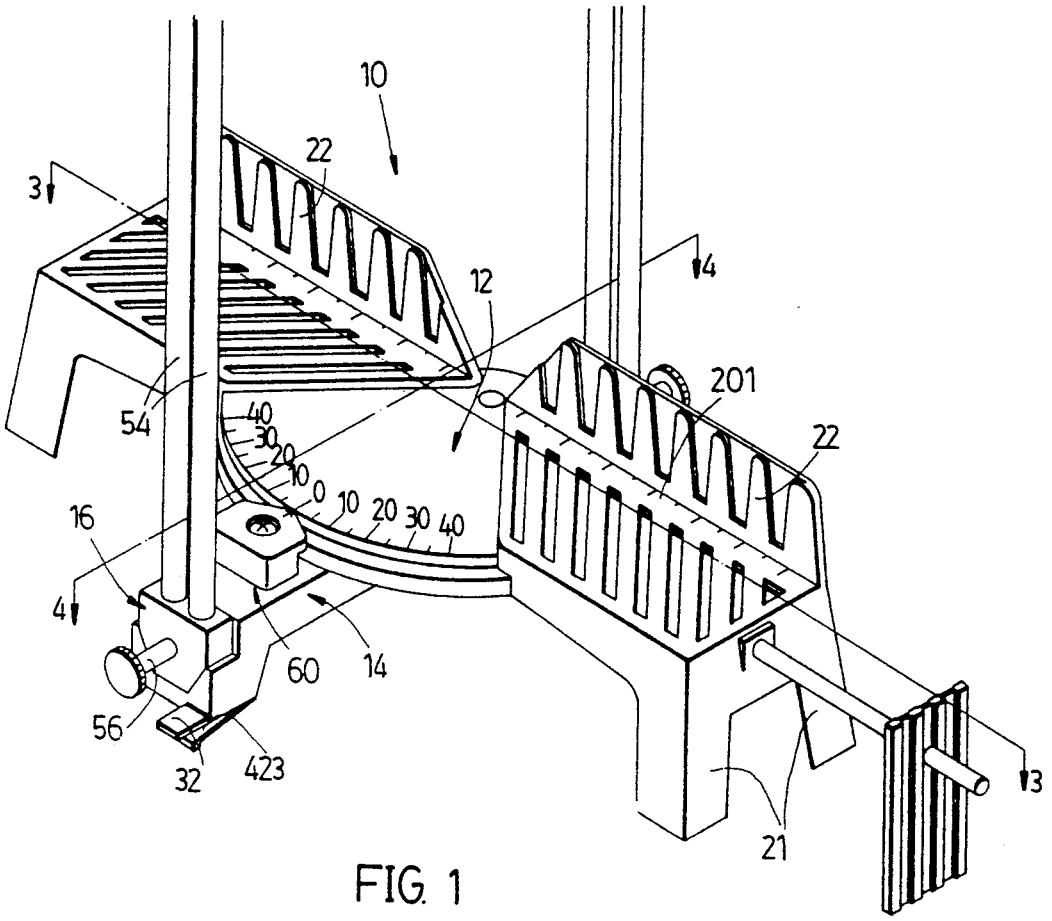
FIG. 1 shows a perspective view of the present invention.
Figure 3:
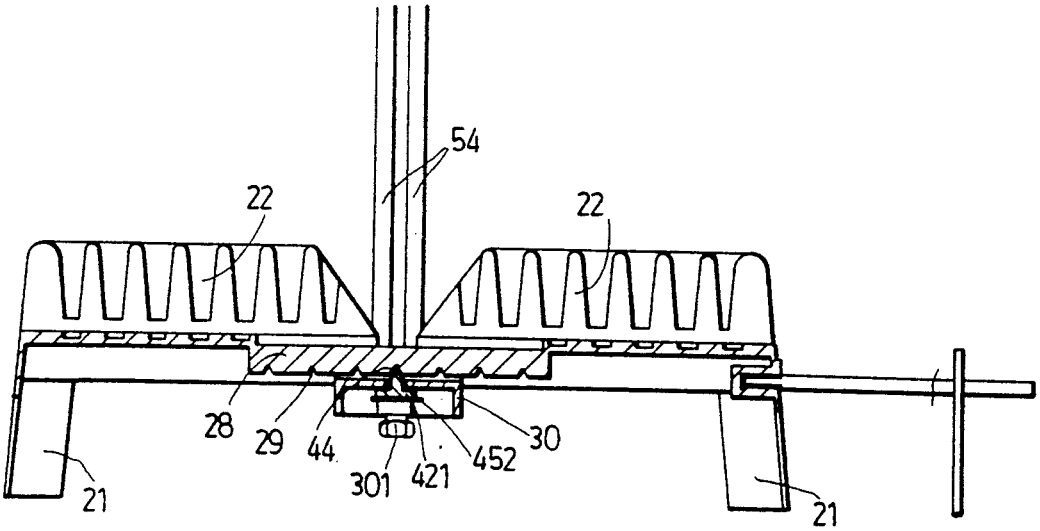
FIG. 3 shows a sectional view of a portion taken along the line 3—3 as shown in FIG. 1.
Figure 2:
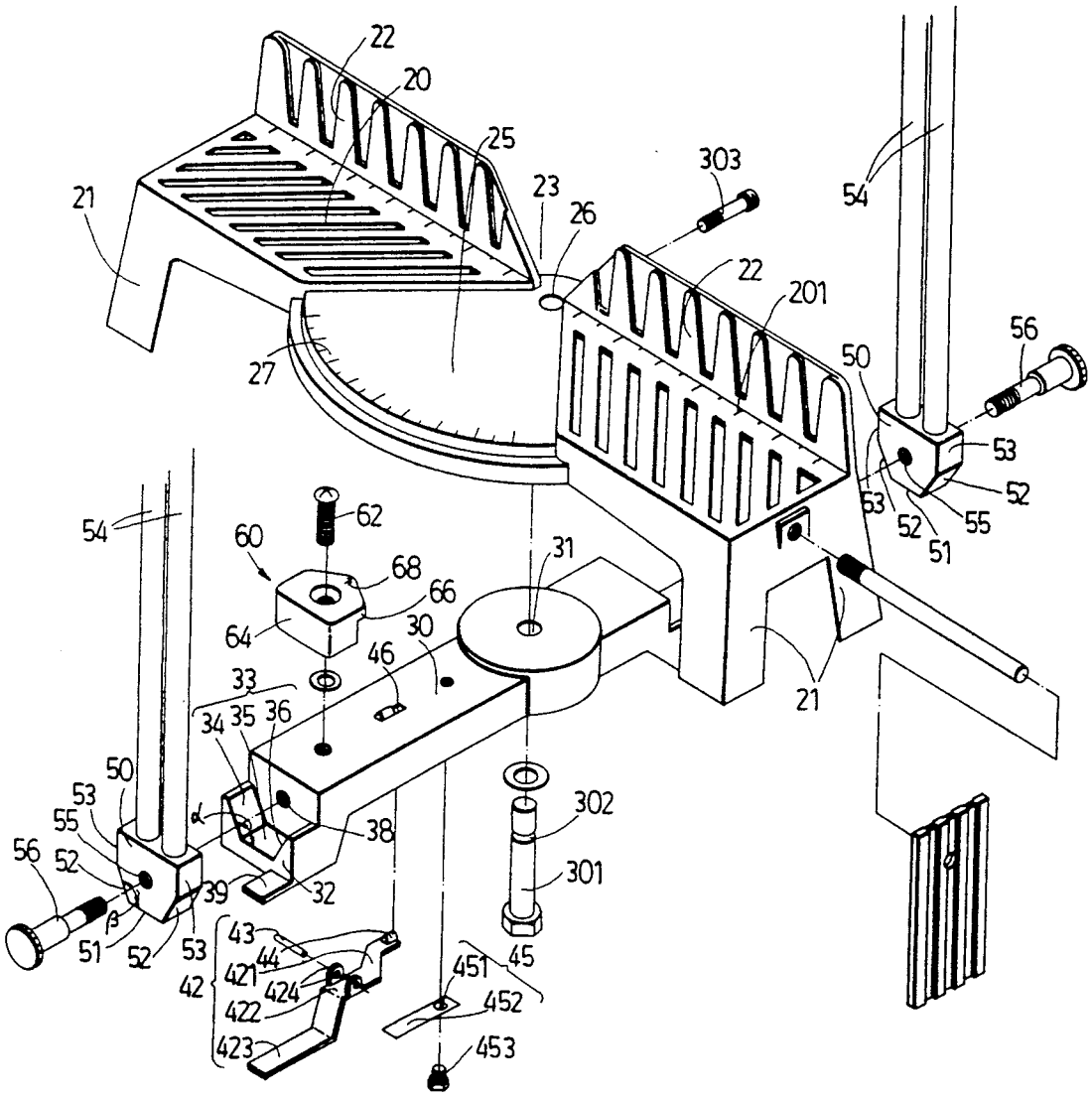
FIG. 2 shows an exploded view of the present invention.
Figure 4:
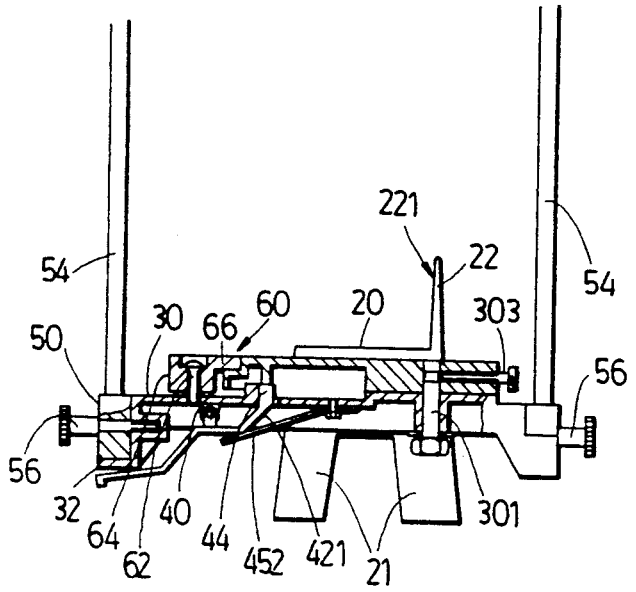
FIG. 4 shows a sectional view of a portion taken along the line 4—4 as shown in FIG. 1.

Referring to all drawings provided herein, a carpenter'workbench 10 of the present invention is shown to comprise a bench top 12, a suspension arm 14 disposed pivotally under the bench top 12, and a pair of sawing supports mounted pivotally and respectively on both ends of the suspension arm 14.

The bench top 12 has a rectangular platform 20 having two ends, each of which is provided integrally with a foot 21 of an appropriate length extending downwards. The platform 20 is further provided on the long side thereof with a baffle 22 of an appropriate height. The baffle 22 is provided at the center thereof with a V-shaped notch 23. A sector step portion 25 forms an angle of 90 degrees and has a first axial hole 26 coplanar with the inner surface 24 of the baffle 22. In addition, the sector step portion 25 has an outer edge portion 27 of an arcuate construction extending slightly beyond another long side of the platform and provided with several retaining grooves 29 of an inverted V shape.

The suspension arm 14 has an arm body 30 having a length greater than the width of the platform 20, and a second axial hole 31. There is a shaft pin 301, which has an annular groove 302 into which a screw 303 is inserted. A pair of receiving mounts 32 are disposed respectively in both ends of the arm body 30. Each of the receiving mounts 32 has a recess 33 and first, second and third receiving surfaces 34, 35 and 36 located by the recess 33 and adjacent to one another. All receiving surfaces have the same length and the same inner angle of 135 degrees. A pair of threaded holes 38 are disposed respectively at both ends of the arm body 30, with the axial center of the threaded hole 38 remaining the same distance from the receiving surfaces 34, 35 and 36. A pair of locking pieces are disposed at the bottom of the receiving mounts 32 in a manner that they extend horizontally for an appropriate length.

The arm body 30 is further provided with a pair of first lugs 40. A curved dial piece 42 is disposed pivotally between the two first lugs 40 by means of a pair of second lugs 424 and an insertion pin 43, which are located at the mid section 422 of the dial piece 42. The front section 421 of the dial piece 42 is provided with a retaining block 44 while the rear section 423 of the dial piece 42 extends forward to reach the underside of the locking piece 39. A spring leaf 45 has a fixed end 451 fastened to the underside of the arm body 30 of the suspension arm 14 by means of a screw 453. The spring leaf 45 further has a free end 42 extending upwards to press against the underside of the front section 421 of the dial piece 42 so as to force the retaining block 44 to extend beyond the upper surface of the arm body 30 via a slot 46 of the arm body 30 which is corresponding in location to the underside of the arcuate rib 28 of the bench top 12. The height of the retaining block 44 is greater than the distance between the lower edge of the rib 28 and the upper surface of the arm body 30. Therefore, the retaining block 44 can be received in the retaining groove 29 at such time when the retaining block 44 moves along with the arm body 30 to a predetermined position. In order to change the rotating angle of the arm body, the rear section 423 of the dial piece 42 is pushed upwards to force the front section 421 to deflect downwards so as to force the retaining block 44 out of the retaining groove 29. As a result, the arm body 30 can be rotated freely.

Each of the sawing supports 16 comprises a retaining mount 50 of a polygonal construction and a pair of support rods 54 which are parallel to each other and are fastened respectively to the retaining mount 50. Each of the retaining mounts 50 has a locating hole 55, a first restraining surface 51 located at the center of the underside thereof, a pair of second restraining surfaces 52 adjacent respectively to both ends of the first restraining surface 51, and a pair of third restraining surface 53 adjacent to the second restraining surfaces 52. All the restraining surfaces 51, 52 and 53 are similar in length in axial direction. The angle formed by the first and the second restraining surfaces 51 and 52 is an angle of 135 degrees and is identical with the angle formed by the second and the third restraining surfaces 52 and 53.

Figure 5:
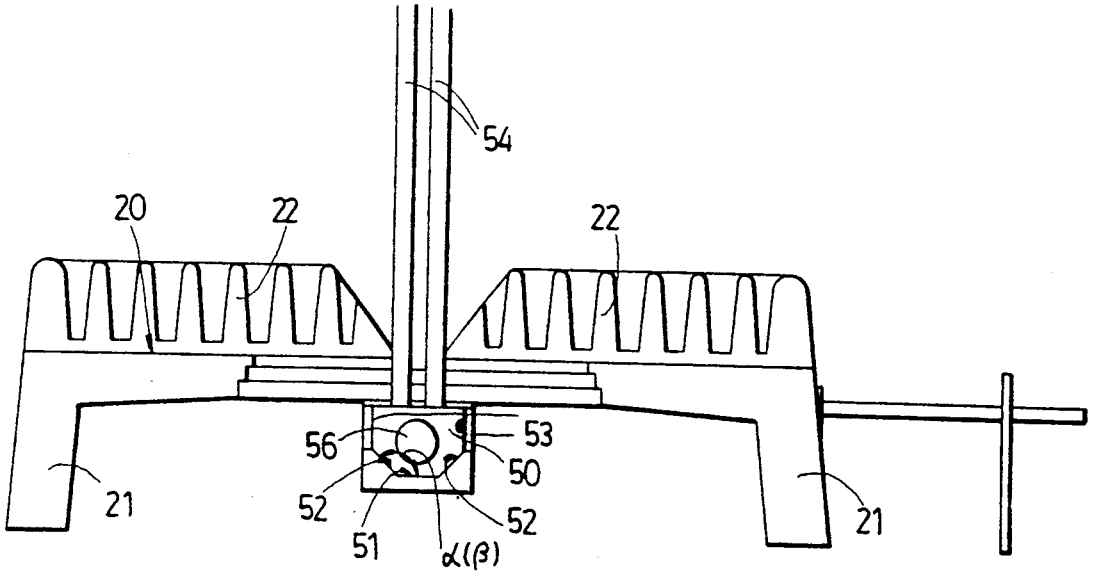
FIG. 5 shows a front elevational view of the present invention.
Figure 6:
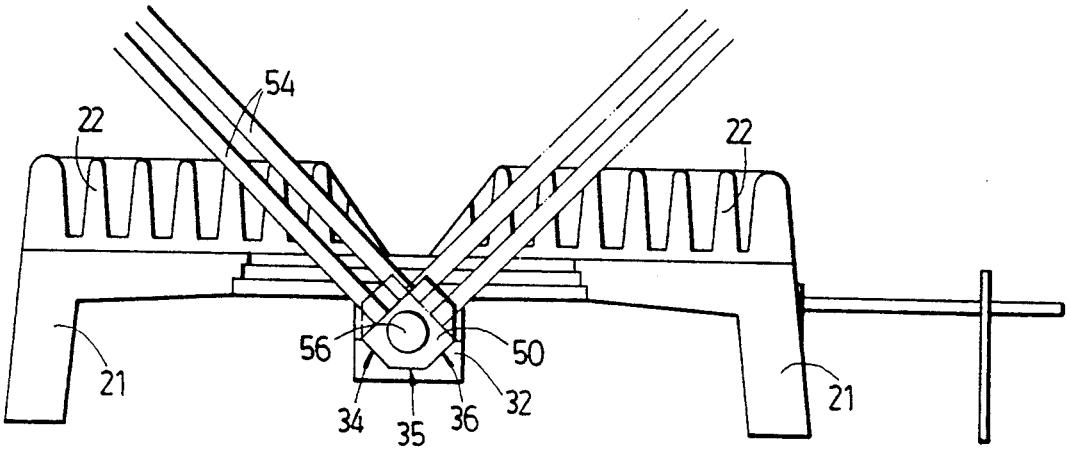
FIG. 6 shows another front elevational view of the present invention.

As illustrated in FIGS. 5 and 6, the combination of the present invention requires that each of the retaining mounts 50 is securely locked in the recess 33 of the receiving mount 32 by means of a bolt 56 in cooperation with the locating hole 55 and the threaded hole 38 of the suspension arm 30. In addition, when the second receiving surface 35 makes contact with the first restraining surface 51, each of support rods 54 is axially vertical to the platform 20 of the bench top 12.

In order to change the angle formed between the support rod 54 and the platform 20, the bolt 56 must be loosened so as to permit the retaining mount 50 to be turned for a predetermined angle and subsequently locked in the receiving mount 32. When the second receiving surface 35 makes contact with the second restraining surface 52, the support rod 54 deflects along with the retaining mount 50 to form with the platform 20 an angle of 45 degrees, either to the left or to the right.

As mentioned previously, the first, the second and the third receiving surfaces 34, 35 and 36 are similar in length to the first, the second and the third restraining surfaces 51, 52 and 53. In addition, the angles $\alpha$ and $\beta$ formed by the receiving surfaces and restraining surfaces are also identical. As a result, when the second restraining surface 52 of the retaining mount 50 presses against the second receiving surface 35 of the receiving mount 32, the first and the third restraining surfaces 51 and 53 are in a close and tight association with the first and the third receiving surfaces 34 and 36, thereby preventing the retaining mount 50 from moving aside at such time when the retaining mount 50 is exerted upon by a force.

Figure 7:
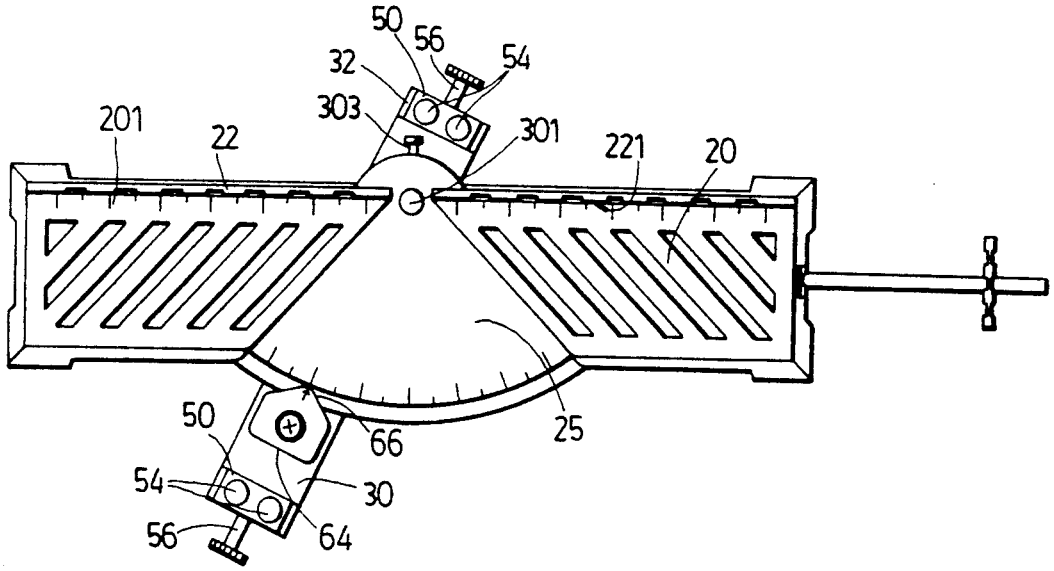
FIG. 7 shows a top elevational view of the present invention.

As shown in FIG. 7, the axial hole 26 of the platform 20 has an axial center, which is coplanar with the inner surface 221 of the baffle 22. Whit the axial center being a starting point, the platform 20 is provided thereon with graduations 201 for use in measuring the length of the cut portion of a wooden material placed on the platform 20.

On the basis of the disclosure of the present invention presented above, it is seen that the carpenter's workbench of the present invention is unique in that the suspension arm 14 and the sawing supports 16 can be easily coordinated to form a desired angle in a manner that the suspension arm 14 and the sawing supports 16 are securely retained, thanks to the polygonal receiving mounts 32 disposed at both ends of the suspension arm 14 and to the polygonal retaining mounts 50 disposed under the sawing supports 16.

What is claimed is:

1. A carpenter's workbench comprising:

a bench top having a rectangular platform provided thereon with a baffle of a height and with a sector sawing portion;

a suspension arm disposed pivotally under said bench top;

a pair of sawing supports, each of which has a retaining mount which can be disposed on an end of said suspension arm and which has a pair of support rods fastened securely thereto;

each of two ends of said suspension arm having a receiving mount;

said receiving mount having a recess with a plurality of intersecting receiving surfaces located on an inner side of said recess;

each of said plurality of intersecting receiving surfaces having a same length;

each intersection of said plurality of intersecting receiving surfaces forming an identical angle greater than 90°;

said retaining mount of said sawing support having a plurality of intersecting surfaces;

each of said plurality of intersecting restraining surfaces having a length equal to said length of said each of said plurality of intersecting receiving surfaces;

each intersection of said plurality of intersecting restraining surfaces forming an angle equal to said identical angle greater than 90° of said each intersection of said plurality of intersecting receiving surfaces;

wherein each said retaining mount can be engaged in each said receiving mount to locate each said pair of support rods at at least one angle less than 90° to an upper plane of said bench top to permit a workpiece on said upper plane to be sawed at said at least one said angle less 90° to said upper plane of said bench top.

2. The carpenter's workbench of claim 1 wherein said recess has at least three receiving surfaces, and wherein said retaining mount has at least three restraining surfaces.

3. The carpenter's workbench of claim 1 wherein said suspension arm has two threaded holes located respectively at said each of two ends of said suspension arm, and wherein said retaining mount has a through hole for fastening said retaining mount to said suspension arm.

4. The carpenter's workbench of claim 1 wherein said baffle has an inner surface coplanar with an axial center of pivoting movement of said suspension arm.

5. The carpenter's workbench of claim 4, wherein said platform is provided thereon with a plurality of length measuring graduations, each of which uses said axial center of said pivoting movement of said suspension arm as a starting point.

6. The carpenter's workbench of claim 1 wherein said sector sawing portion is provided with an arcuate rib of a height which has a plurality of retaining grooves spaced at a predetermined angle.

7. The carpenter's workbench of claim 6 wherein said suspension arm is further provided with a slot corresponding in location to an underside of said arcuate rib; and with a dial piece disposed pivotally under said suspension arm, said dial piece having a retaining block of a length located on an inner side thereof and having an outer side extending beyond said suspension arm; and further with an elastic member having a fixed end mounted on said suspension arm and having a free end urging said inner side of said dial piece in a manner that said inner side of said dial piece is pushed upwards so as to force said retaining block to move upwards and beyond said suspension arm to enter said retaining grooves of said arcuate rib.

8. The carpenter's workbench of claim 7 wherein said elastic member is a spring leaf.

* * * * *